US007810558B2

(12) United States Patent
Shkurti et al.

(10) Patent No.: US 7,810,558 B2
(45) Date of Patent: Oct. 12, 2010

(54) DRILLABLE BRIDGE PLUG

(75) Inventors: Piro Shkurti, The Woodlands, TX (US); Lap T. Tran, Houston, TX (US); William M. Roberts, Tomball, TX (US); George J. Melenyzer, Cypress, TX (US)

(73) Assignee: Smith International, Inc., Houston, TX (US)

( * ) Notice: Subject to any disclaimer, the term of this patent is extended or adjusted under 35 U.S.C. 154(b) by 230 days.

(21) Appl. No.: 11/967,881

(22) Filed: Dec. 31, 2007

(65) Prior Publication Data

US 2008/0190600 A1 Aug. 14, 2008

Related U.S. Application Data

(63) Continuation-in-part of application No. 11/064,306, filed on Feb. 23, 2005, now Pat. No. 7,424,909.

(60) Provisional application No. 60/548,718, filed on Feb. 27, 2004.

(51) Int. Cl.
*E21B 33/12* (2006.01)
*E21B 23/00* (2006.01)

(52) U.S. Cl. ..... 166/138; 166/192

(58) Field of Classification Search ..... 166/196, 166/192, 118, 138
See application file for complete search history.

(56) References Cited

U.S. PATENT DOCUMENTS 3,910,348 A 10/1975 Pitts
5,701,959 A 12/1997 Hushbeck et al.
6,491,108 B1 12/2002 Slup et al.
6,695,050 B2 2/2004 Winslow et al.
2004/0251025 A1 * 12/2004 Giroux et al. ..... 166/291

OTHER PUBLICATIONS

U.S. Office Action for related U.S. Appl. No. 12/198,859, dated Dec. 17, 2008, (5 pages).
U.S. Office Action for correspoding U.S. Appl. No. 11/064,306 with Notice of References cited dated Jan. 25, 2008, (7 pages).

* cited by examiner

*Primary Examiner*—David J Bagnell
*Assistant Examiner*—Catherine Loikith
(74) *Attorney, Agent, or Firm*—Osha Liang LLP

(57) ABSTRACT

A downhole tool for isolating zones in a well includes a mandrel, a sealing element disposed around the mandrel, an upper cone disposed around the mandrel proximate an upper end of the sealing element, an upper slip assembly disposed around the mandrel adjacent a sloped surface of the upper cone, a lower cone disposed around the mandrel proximate a lower end of the sealing element, a lower slip assembly disposed around the mandrel adjacent a sloped surface of the lower cone, and two element end rings. The two element end rings include a first element end ring disposed adjacent the upper end of the sealing element and a second element end ring disposed adjacent the lower end of the sealing element. The downhole tool includes two element barrier assemblies; each assembly disposed adjacent one of the two element end rings.

24 Claims, 15 Drawing Sheets

DRILLABLE BRIDGE PLUG

CROSS-REFERENCE TO RELATED APPLICATIONS

This application claims the benefit pursuant to 35 U.S.C. §120 as a continuation-in-part application of U.S. patent application Ser. No. 11/064,306, filed Feb. 23, 2005, which claims priority from Ser. No. 60/548,718, filed on Feb. 27, 2004. The above referenced applications are hereby incorporated by reference in their entirety.

BACKGROUND OF INVENTION

1. Field of the Invention

Embodiments disclosed herein relate generally to methods and apparatus for drilling and completing well bores. More specifically, embodiments disclosed herein relate to methods and apparatus for a drillable bridge plug.

2. Background Art

In drilling, completing, or reworking wells, it often becomes necessary to isolate particular zones within the well. In some applications, downhole tools, known as temporary or permanent bridge plugs, are inserted into the well to isolate zones. The purpose of the bridge plug is to isolate some portion of the well from another portion of the well. In some instances, perforations in the well in one section need to be isolated from perforations in another section of the well. In other situations, there may be a need to use a bridge plug to isolate the bottom of the well from the wellhead.

Drillable bridge plugs generally include a mandrel, a sealing element disposed around the mandrel, a plurality of backup rings disposed around the mandrel and adjacent the sealing element, an upper slip assembly and a lower slip assembly disposed around the mandrel, and an upper cone and a lower cone disposed around the mandrel adjacent the upper and lower slip assemblies, respectively. FIG. 1 shows a section view of a well 10 with a wellbore 12 having a bridge plug 15 disposed within a wellbore casing 20. The bridge plug 15 is typically attached to a setting tool and run into the hole on wire line or tubing (not shown), and then actuated with, for example, a hydraulic system. As illustrated in FIG. 1, the wellbore is sealed above and below the bridge plug so that oil migrating into the wellbore through perforations 23 will be directed to the surface of the well.

The drillable bridge plug may be set by wireline, coil tubing, or a conventional drill string. The plug may be placed in engagement with the lower end of a setting tool that includes a latch down mechanism and a ram. The plug is then lowered through the casing to the desired depth and oriented to the desired orientation. When setting the plug, a setting tool pulls upwardly on the mandrel, thereby pushing the upper and lower cones along the mandrel. This forces the upper and lower slip assemblies, backup rings, and the sealing element radially outward, thereby engaging the segmented slip assemblies with the inside wall of the casing. It has been found that once the plug is set, the slip assemblies may not be uniformly disposed around the inside wall of the casing. This non-uniform positions of the segmented slip assemblies results in uneven stress distribution on the segmented slip assemblies and the adjacent cones. An uneven stress distribution may limit the axial load capacities of the slip assemblies and casing, and reduce the collapse strength of the adjacent cones.

Further, due to the makeup or engagement of the backup rings adjacent the sealing element sealing element, the backup rings may provide an extrusion path for the sealing element. Extrusion of the sealing element causes loosening of the seal against the casing wall, and may therefore cause the downhole tool to leak.

Additionally, it has been found that downhole tools may leak at high pressures unless they include a means for increasing the seal energization, such as a pressure responsive self-energizing feature. Leakage occurs because even when a high setting force is used to set the downhole tool seals, once the setting force is removed, the ratchet system of the lock ring will retreat slightly before being arrested by the locking effect created when the sets of ratchet teeth mate firmly at the respective bases and apexes of each. This may cause a loosening of the seal. Downhole tools are also particularly prone to leak if fluid pressures on the packers are cycled from one direction to the other.

When it is desired to remove one or more of these bridge plugs from a wellbore, it is often simpler and less expensive to mill or drill them out rather than to implement a complex retrieving operation. In milling, a milling cutter is used to grind the tool, or at least the outer components thereof, out of the well bore. In drilling, a drill bit or mill is used to cut and grind up the components of the bridge plug to remove it from the wellbore. It has been found that when drilling up a bridge plug, lower components of the bridge plug may no longer engage the mandrel. Thus, as the drill rotates to drill up the plug, the lower components spin or rotate within the well. This spinning or rotation of the lower components during drilling of the plug increases the time required to drill up the plug.

Accordingly, there exists a need for a bridge plug that effectively seals a wellbore. Additionally, there exists a need for a bridge plug that may sustain a greater load capacity and increases the collapse strength of components of the bridge plug. Further, a bridge plug that is easier to drill up is also desired.

SUMMARY OF INVENTION

In one aspect, embodiments disclosed herein relate to a downhole tool for isolating zones in a well, the tool including a mandrel, a sealing element disposed around the mandrel, an upper cone disposed around the mandrel proximate an upper end of the sealing element, an upper slip assembly disposed around the mandrel adjacent a sloped surface of the upper cone, a lower cone disposed around the mandrel proximate a lower end of the sealing element, a lower slip assembly disposed around the mandrel adjacent a sloped surface of the lower cone, two element end rings, a first element end ring disposed adjacent the upper end of the sealing element and a second element end ring disposed adjacent the lower end of the sealing element, and two element barrier assemblies, each assembly disposed adjacent one of the two element end rings.

In another aspect, embodiments disclosed herein relate to a downhole tool for isolating zones in a well, the tool including a mandrel, a sealing element disposed around the mandrel two slip assemblies disposed around the mandrel, wherein an upper slip assembly is disposed proximate an upper end of the sealing element and a lower slip assembly is disposed proximate a lower end of the sealing element, an upper cone disposed around the mandrel between the first slip assembly and the upper end of the sealing element, and a lower cone disposed around the mandrel between the first slip assembly and the lower end of the sealing element, wherein the mandrel includes a central bore and wherein a movable bridge is disposed between two stops in the central bore.

Other aspects and advantages of the invention will be apparent from the following description and the appended claims.

DETAILED DESCRIPTION

Figure 1:
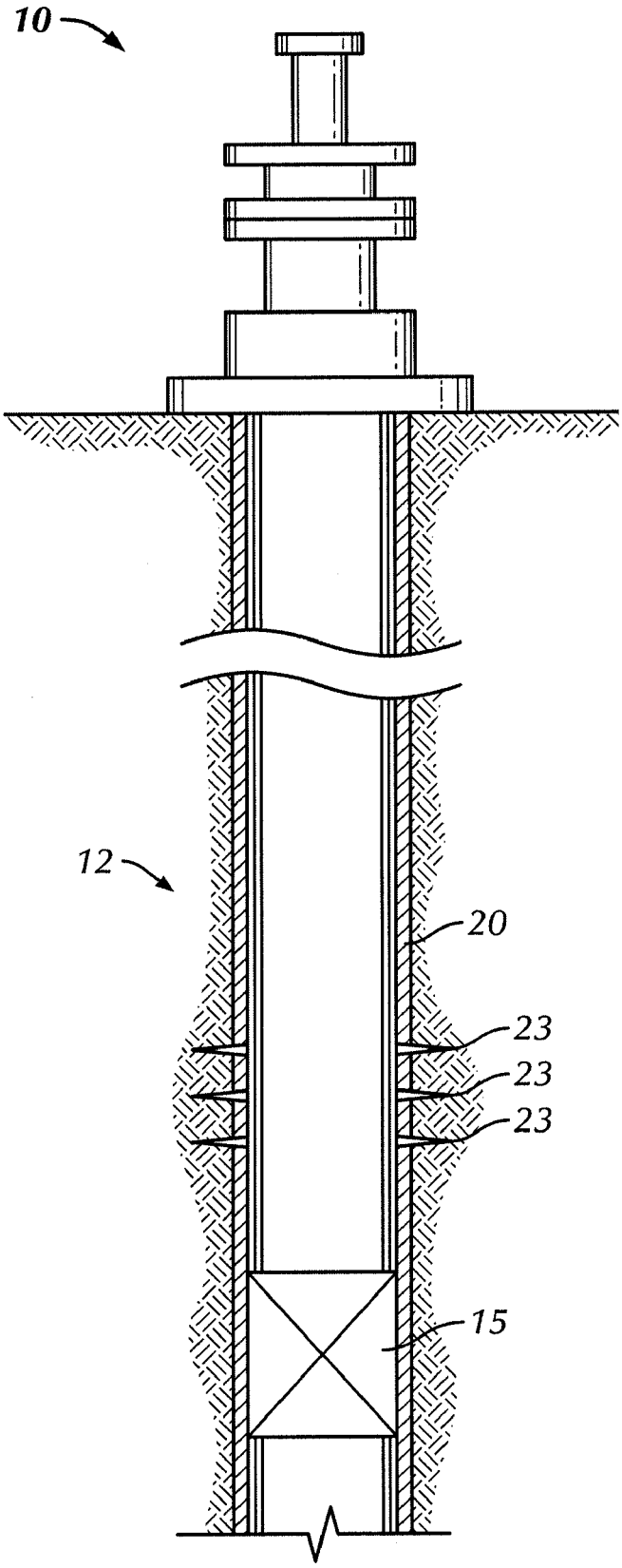
FIG. 1 shows a section view of a prior art plug assembly as set in a wellbore.

In one aspect, embodiments disclosed herein relate generally to a downhole tool for isolating zones in a well. In certain aspects, embodiments disclosed herein relate to a downhole tool for isolating zones in a well that provides efficient sealing of the well. In another aspect, embodiments disclosed herein relate to a downhole tool for isolating zones in a well that may be more quickly drilled or milled up. In certain aspects, embodiments disclosed herein relate to bridge plugs and frac plugs.

Like elements in the various figures are denoted by like reference numerals for consistency.

Figure 2A:
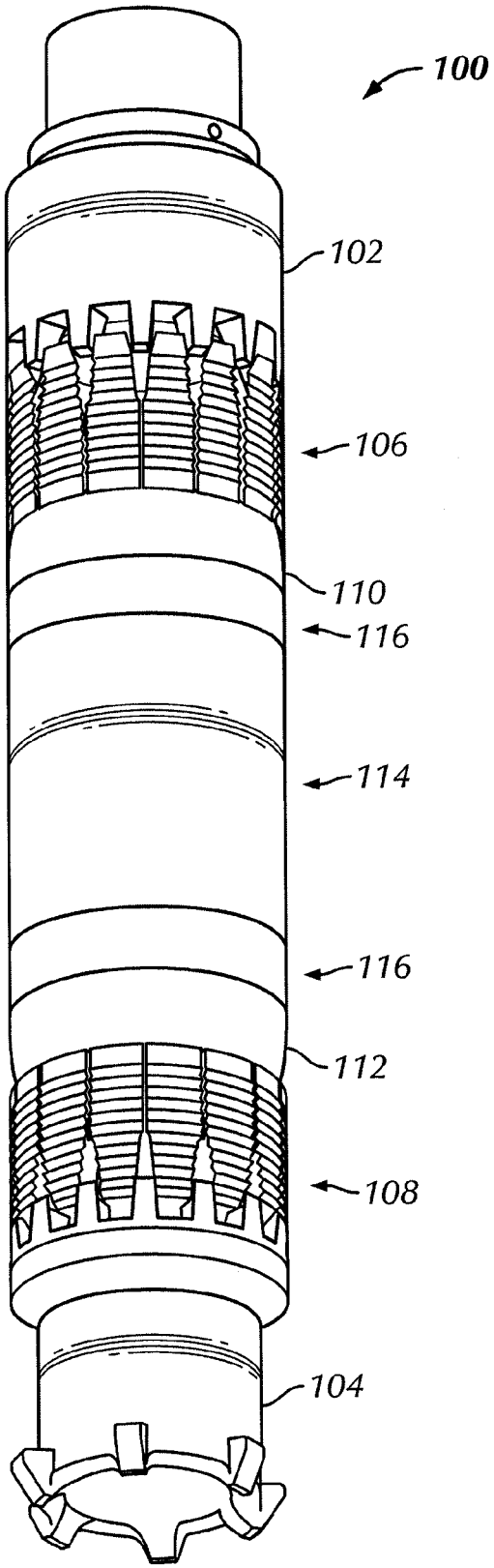
FIG. 2A is a perspective view of a bridge plug in accordance with embodiments disclosed herein.
Figure 2B:
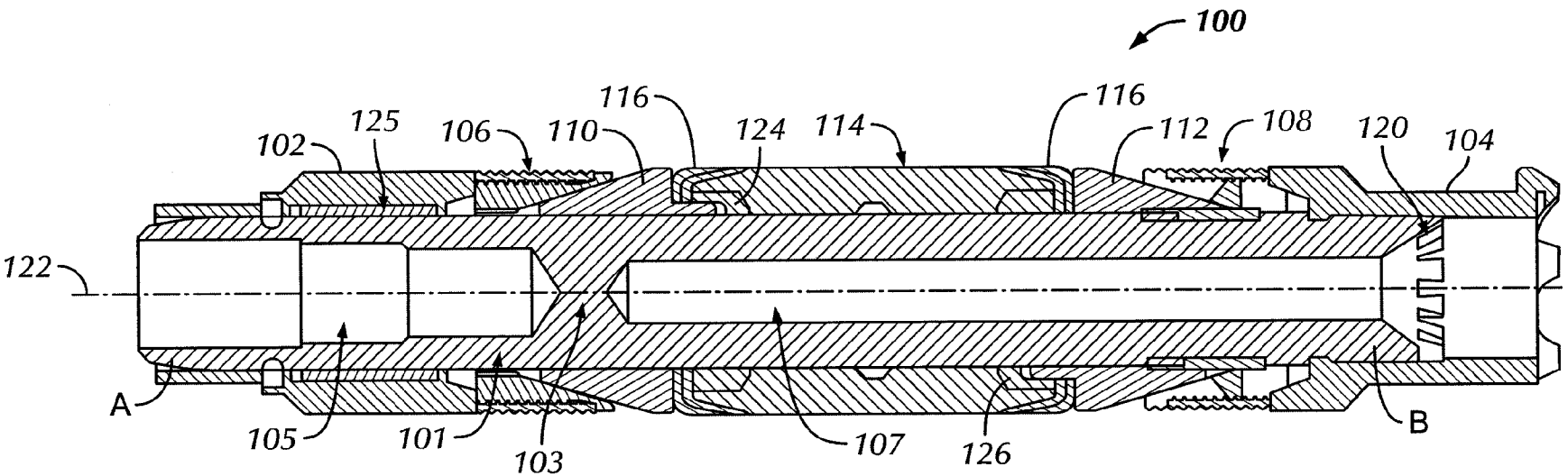
FIG. 2B is a cross-sectional view of a bridge plug in accordance with embodiments disclosed herein.

Referring now to FIGS. 2A and 2B, a bridge plug 100 in accordance with one embodiment of the present disclosure is shown in an unexpanded condition, or after having been run downhole but prior to setting it in the wellbore. The unexpanded condition is defined as the state in which the bridge plug 100 is run downhole, but before a force is applied to axially move components of the plug 100 and radially expand certain components of the plug 100 to engage a casing wall. As shown, bridge plug 100 includes a mandrel 101 having a central axis 122, about which other components of the plug 100 are mounted. The mandrel 101 includes an upper end A and a lower end B, wherein the upper end A and lower end B of the mandrel 101 include a threaded connection (not shown), for example, a taper thread. The lower end B of the mandrel 101 also includes a plurality of tongues 120 disposed around the lower circumference of the mandrel 101.

In one embodiment, mandrel 101 includes a bridge 103 integrally formed with the mandrel 101. As shown in FIG. 2B, the bridge 103 is formed between two internal bores 105, 107 formed in the mandrel 101 and disposed proximate an upper cone 110 when the bridge plug 100 is assembled. In this embodiment, upper internal bore 105 has a diameter greater that lower internal bore 107. Pressure applied from above the bridge plug 100 provides a collapse pressure on the mandrel, whereas pressure applied from below the bridge plug 100 provides a burst pressure on the mandrel 101.

Figure 2C:
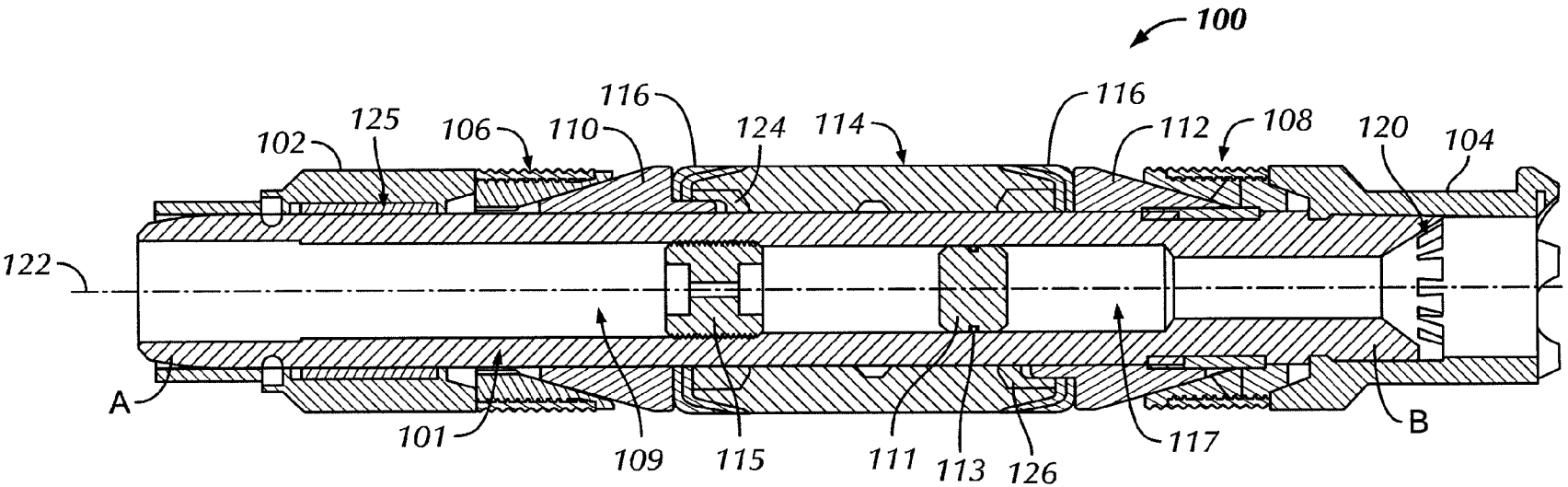
FIG. 2C is a cross-sectional view of a bridge plug in accordance with embodiments disclosed herein.

In an alternate embodiment, as shown in FIG. 2C, mandrel 101 is formed with a single bore 109 having a substantially constant diameter along the length of the mandrel 101. In this embodiment, an upper stop block 115 is disposed in the bore 109. In one embodiment, the upper stop block 115 is a solid cylindrical component sealingly engaged with an inner wall of the mandrel and disposed proximate an upper end of the sealing element 114. Alternatively, the upper stop block 115 may be a hollow cylindrical component, or a cylindrical component with a bore therethrough, sealingly engaged with the inner wall of the mandrel. A movable bridge 111 is disposed in the bore 109 below the upper stop block 115. A sealing element 113, for example, an elastomeric ring or o-ring, is disposed around the moveable bridge 111, such that the sealing element 113 and the outer surface of the moveable bridge 111 provide a seal against the inner wall of the mandrel 101. A lower stop block 117 is disposed below the moveable bridge 111. As shown, lower stop block 117 is formed by a change in the inner diameter of the mandrel 101. As such, in this embodiment, lower stop block 117 is a bearing shoulder. In alternate embodiment, upper stop block 115 may be a similar bearing shoulder, while lower stop block 117 is a solid cylindrical component or a cylindrical component with a bore therethrough, sealingly engaged with the inner wall of the mandrel.

When a pressure differential is applied to the bridge plug 100, the movable bridge 111 moves upward or downward in the mandrel 101 between the upper and lower stop blocks 115, 117. Thus, the movable bridge 111 acts like a piston moving within a piston housing, i.e., the mandrel 101. Movement of the movable bridge 111 with respect to the applied pressure may reduce the differential pressure across the cross-section of the mandrel 101 proximate a sealing element 114 or may provide a burst pressure on the mandrel 101.

Figure 3A:
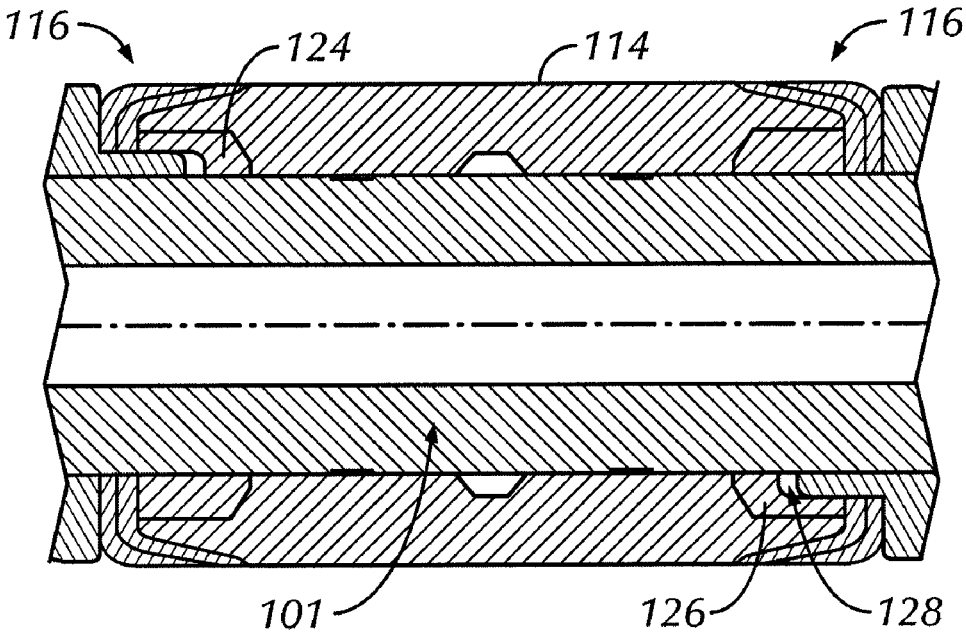
FIGS. 3A and 3B show a sealing element in accordance with embodiments disclosed herein.
Figure 3B:
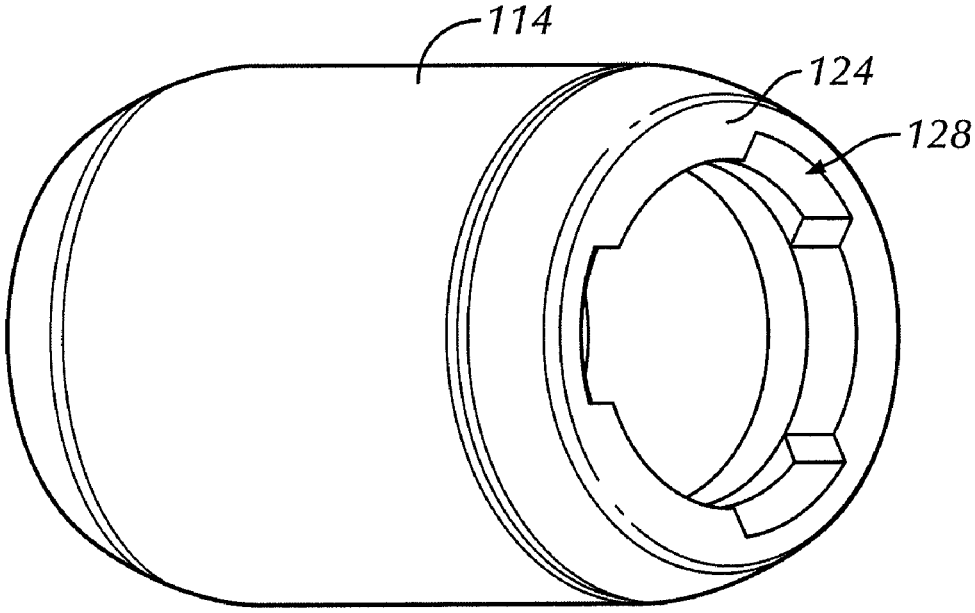

Sealing element 114 is disposed around the mandrel 101. The sealing element 114 seals an annulus between the bridge plug 100 and the casing wall (not shown). The sealing element 114 may be formed of any material known in the art, for example, elastomer or rubber. Two element end rings 124, 126 are disposed around the mandrel 101 and proximate either end of sealing element 114, radially inward of the sealing element 114, as shown in greater detail in FIGS. 3A and 3B. In one embodiment, sealing element 114 is bonded to an outer circumferential area of the element end rings 124, 126 by any method know in the art. Alternatively, the sealing element 114 is molded with the element end rings 124, 126. The element end rings 124, 126 may be solid rings or small tubular pieces formed from any material known in the art, for example, a plastic or composite material. The element end rings 124, 126 have at least one groove or opening 128 formed on an axial face and configured to receive a tab (not shown) formed on the end of an upper cone 110 and a lower cone 112, respectively, as discussed in greater detail below. One of ordinary skill in the art will appreciate that the number and location of the grooves 128 formed in the element end rings 124, 126 corresponds to the number and location of the tabs (not shown) formed on the upper and lower cones 110, 112.

Figure 4:
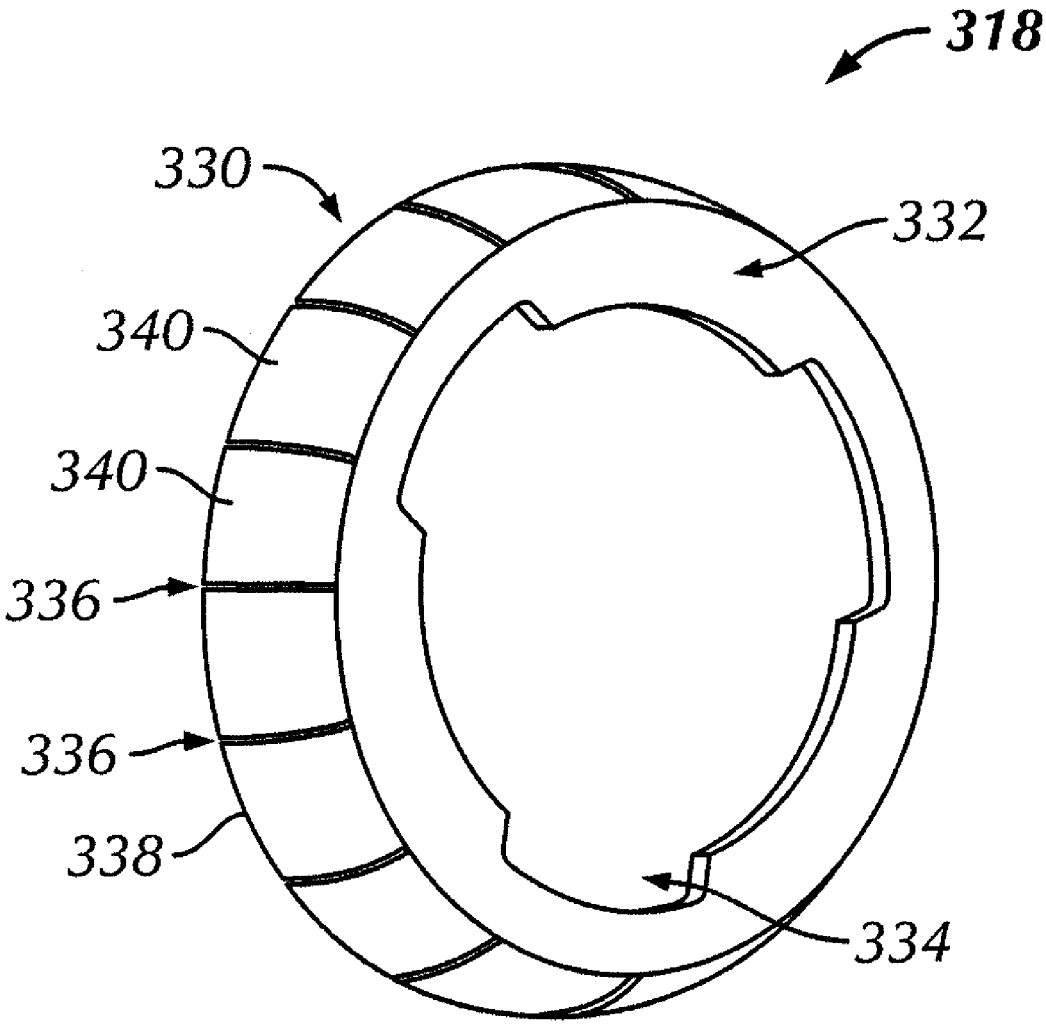
FIG. 4 is a perspective view of a barrier ring in accordance with embodiments disclosed herein.

Bridge plug 100 further includes two element barrier assemblies 116, each disposed adjacent an end of the sealing element 114 and configured to prevent or reduce extrusion of the sealing element 114 when the plug 100 is set. Each element barrier assembly 116 includes two barrier rings. As shown in FIG. 4, a barrier ring 318 in accordance with embodiments disclosed herein, is a cap-like component that has a cylindrical body 330 with a first face 332. First face 332 has a circular opening therein such that the barrier ring 318 is configured to slide over the mandrel 101 into position adjacent the sealing element 114 and the element end ring 124, 126. At least one slot 334 is formed in the first face 332 and configured to align with the groves 128 formed in the element end rings 124, 126 and to receive the tabs formed on the upper and lower cones 110, 112. One of ordinary skill in the art will appreciate that the number and location of the slots 334 formed in the first face 332 of the barrier ring 318 corresponds to the number and location of the grooves 128 formed in the element end rings 124, 126 and the number and location of the tabs (not shown) formed on the upper and lower cones 110, 112.

Barrier rings 318 may be formed from any material known in the art. In one embodiment, barrier rings 318 may be formed from an alloy material, for example, aluminum alloy. A plurality of slits 336 are disposed on the cylindrical body 330 of the barrier ring 318, each slit 336 extending from a second end 338 of the barrier ring 318 to a location behind the front face 332, thereby forming a plurality of flanges 340. When assembled, the two barrier rings 318 of the backup assembly (116 in FIG. 2B) are aligned such that the slits 336 of the first barrier ring are rotationally offset from the slits 336 of the second barrier ring. Thus, when the bridge plug (100 in FIG. 2B) is set, and the components of the bridge plug are compressed, the flanges 340 of the first and second barrier rings radially expand against the inner wall of the casing and create a circumferential barrier that prevents the sealing element (114 in FIG. 2B) from extruding.

Referring back to FIGS. 2A and 2B, bridge plug 100 further includes upper and lower cones 110, 112 disposed around the mandrel 101 and adjacent element barrier assemblies 116. The upper cone 110 may be held in place on the mandrel 101 by one or more shear screws (not shown). In some embodiments, an axial locking apparatus (not shown), for example lock rings, are disposed between the mandrel 101 and the upper cone 110, and between the mandrel 101 and the lower cone 112. Additionally, at least one rotational locking apparatus (not shown), for example keys, may be disposed between the mandrel 101 and the each of the upper cone 110 and the lower cone 112, thereby securing the mandrel 101 in place in the bridge plug 100 during the drilling or milling operation used to remove the bridge plug. An upper slip assembly 106 and a lower slip assembly 108 are disposed around the mandrel 101 and adjacent the upper and lower cones 110, 112, respectively. The bridge plug 100 further includes an upper gage ring 102 disposed around the mandrel 101 and adjacent the upper slip assembly 106, and a lower gage ring 104 disposed around the mandrel 101 and adjacent the lower slip assembly 108.

Figure 5A:
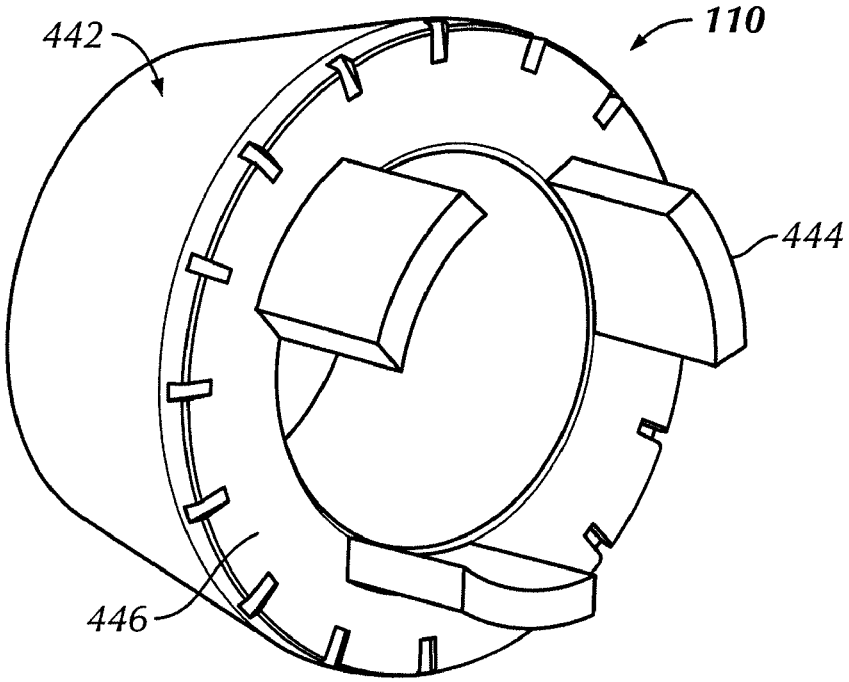
FIGS. 5A and 5B show perspective views of an upper cone and a lower cone, respectively, in accordance with embodiments disclosed herein.
Figure 5B:
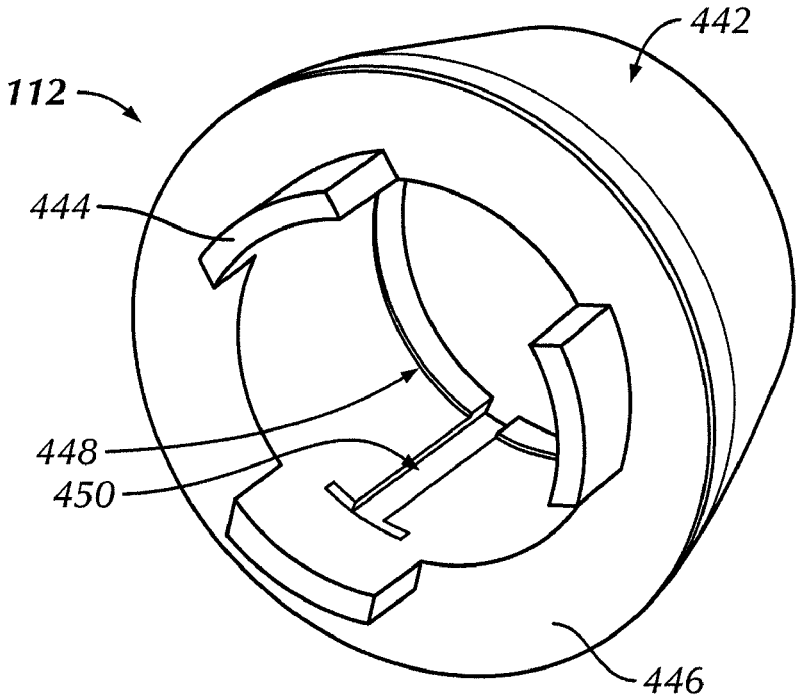

Referring now to FIGS. 5A and 5B, upper and lower cones 110, 112 have a sloped outer surface 442, such that when assembled on the mandrel, the outer diameter of the cone 110, 112 increases in an axial direction toward the sealing element (114 in FIG. 2B). Upper and lower cones 110, 112 include at least one tab 444 formed on a first face 446. The at least one tab 444 is configured to fit in a slot (334 in FIG. 4) formed in a first face (332) of the barrier rings (318) of the element barrier assembly (116 in FIG. 2B) and to engage the grooves (128 in FIG. 3B) in the element end rings (124, 126). One of ordinary skill in the art will appreciate that the number and location of tabs 444 corresponds to the number and location of the slots (334) formed in the first face (332) of the barrier ring (318) and the number and location of the grooves (128) formed in the element end rings (124, 126).

Briefly referring back to FIG. 2B, the engaged tabs (444 in FIG. 6) of the upper and lower cones 110, 112 rotationally lock the upper and lower cones 110, 112, with the upper and lower element barrier assemblies 116 and the element end rings 124, 126. Thus, during a drilling/milling process, i.e. drilling/milling the bridge plug out of the casing, the cones 110, 112, element barrier assemblies 116, and sealing element 114 are more easily and quickly drilled out, because the components do not spin relative to one another.

Referring back to FIGS. 5A and 5B, upper and lower cones 110, 112 are formed of a metal alloy, for example, aluminum alloy. In certain embodiments, upper and lower cones 110, 112 may be formed from a metal alloy and plated with another material. For example, in one embodiment, upper and lower cones 110, 112 may be copper plated. The present inventors have advantageously found that copper plated cones 110, 112 reduce the friction between components moving along the sloped surface 442 of the cones 110, 112, for example, the slip assemblies (106, 108 in FIG. 2B), thereby providing a more efficient and better-sealing bridge plug (100).

Figure 6:
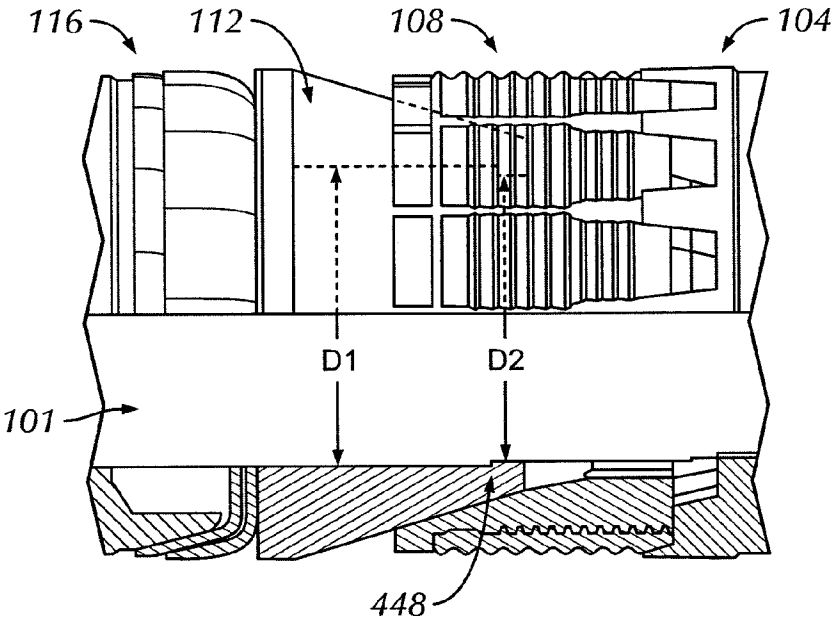
FIG. 6 shows a partial cross-sectional view of a bridge plug in accordance with embodiments disclosed herein.

As shown in FIG. 6, lower cone 112 has a first inside diameter D1 and a second inside diameter D2, such that a bearing shoulder 448 is formed between the first inside diameter D1 and the second inside diameter D2. The bearing shoulder 448 corresponds to a matching change in the outside diameter of the mandrel 101, such that during a drilling or milling process, the mandrel 101 stays in position within the bridge plug 100. In other words, the bearing shoulder 448 prevents the mandrel from falling out of the bridge plug 100 during a drilling or milling process.

Figure 7:
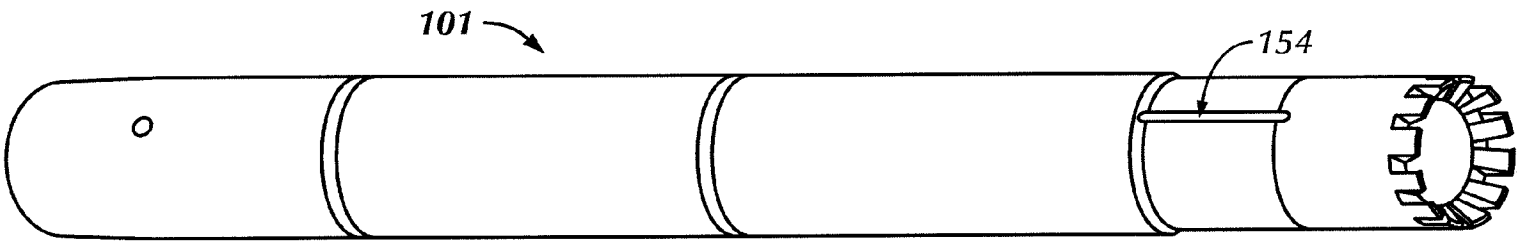
FIG. 7 is a perspective view of a mandrel of a bridge plug in accordance with embodiments disclosed herein.

Briefly referring back to FIG. 5B, lower cone 112 includes at least one axial slot 450 disposed on an inner surface. At least one key slot (154 in FIG. 7) is also formed on an outer diameter of the mandrel 101. When the lower cone 112 is disposed around the mandrel 101, the axial slot 450 and the key slot 154 are aligned and a rotational locking key (not shown) is inserted into the matching slots of the lower cone 112 and the mandrel 101. Thus, when inserted, the rotational locking key rotationally lock the lower cone 112 and the mandrel 101 during a drilling/milling process, thereby preventing the relative moment of one from another. One of ordinary skill in the art will appreciate that the key and key slots may be of any shape known in the art, for example, the key and corresponding key slot may have square cross-sections or any other shape cross-section. Further, one of ordinary skill in the art will appreciate that the rotational locking key may be formed of any material known in the art, for example, a metal alloy.

Figure 8:
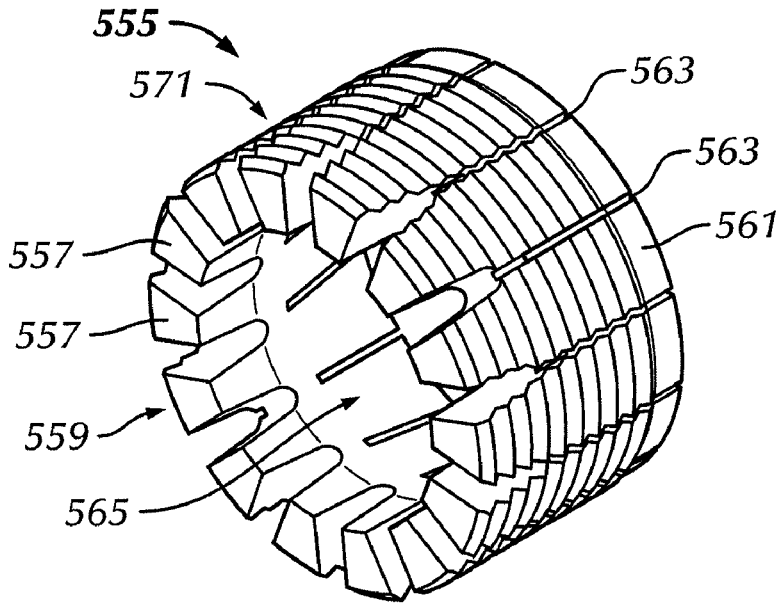
FIG. 8 is a perspective view of a slip assembly in accordance with embodiments disclosed herein.

Referring generally to FIGS. 2A and 2B, upper and lower slip assemblies 106, 108 are disposed adjacent upper and lower cones 110 and 112. Upper and lower gage rings 102 and 104 are disposed adjacent to and engage upper and lower slip assemblies 106, 108. Referring now to FIG. 8, in one embodiment, upper and lower slip assemblies include a frangible anchor device 555. Frangible anchor device 555 is a cylindrical component having a first end 559 and a second end 561. A plurality of castellations 557 is formed on the first end 559. The plurality of castellations 557 is configured to engage a corresponding plurality of castellations 662, 664 on upper and lower gage rings 102, 104, respectively (see FIGS. 9 and 10).

The second end 561 of the frangible anchor device 555 has a conical inner surface 565 configured to engage the sloped outer surfaces 442 of the upper and lower cones 110, 112 (see FIGS. 5A and 5B). Further, at least two axial slots 563 are formed in the second end 561 that extend from the second end 561 to a location proximate the castellations 557 of the first end 559. The axial slots 563 are spaced circumferentially around the frangible anchor device 555 so as to control the desired break-up force of the frangible anchor device 555. A plurality of teeth 571, sharp threads, or other configurations known in the art are formed on an outer surface of frangible anchor device 555 and are configured to grip or bite into a casing wall. In one embodiment, frangible anchor device 555, including teeth, is formed of a single material, for example, cast iron.

Figure 11:
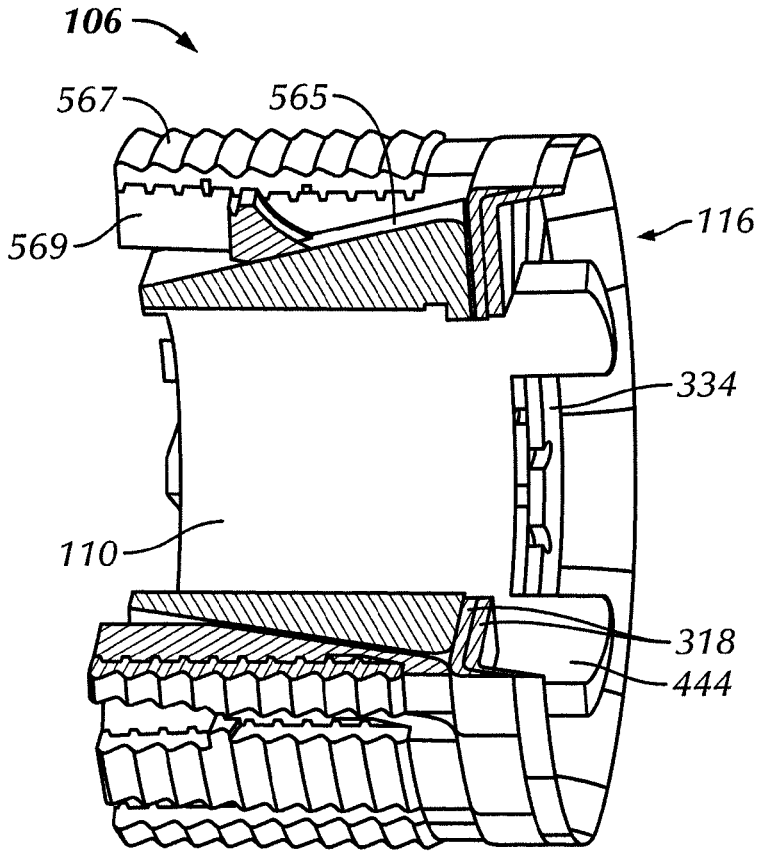
FIG. 11 is a partial cross-sectional view of an assembled slip assembly, upper cone, and element barrier assembly in accordance with embodiments disclosed herein.

In alternate embodiments, as shown in FIG. 11, slip assemblies 106, 108 include slips 567 disposed on an outer surface of a slip base 569. Slips 567 may be configured as teeth, sharp threads, or any other device know to one of ordinary skill in the art for gripping or biting into a casing wall. In certain embodiments, slip base 569 may be formed from a readily drillable material, while slips 567 are formed from a harder material. For example, in one embodiment, the slip base 569 is formed from a low yield cast aluminum and the slips 567 are formed from cast iron. One of ordinary skill in the art will appreciate that other materials may be used and that in certain embodiments the slip base 569 and the slips 567 may be formed from the same material without departing from the scope of embodiments disclosed herein.

FIG. 11 shows a partial perspective view of an assembly of the upper slip assembly 106, upper cone 110, and element barrier assembly 116. As shown, the conical inner surface 565 of slip base 569 is disposed adjacent the sloped surface 442 of the upper cone 110. Slips 567 are disposed on an outer surface of the slip base 569. Tabs 444 formed on a lower end of upper cone 110 are inserted through slots 334 in each of the two barrier rings 318 that form element barrier assembly 116. As shown, the slip assembly 106 may provide additional support for the sealing element (114 in FIG. 2), thereby limiting extrusion of the sealing element.

Figure 9:
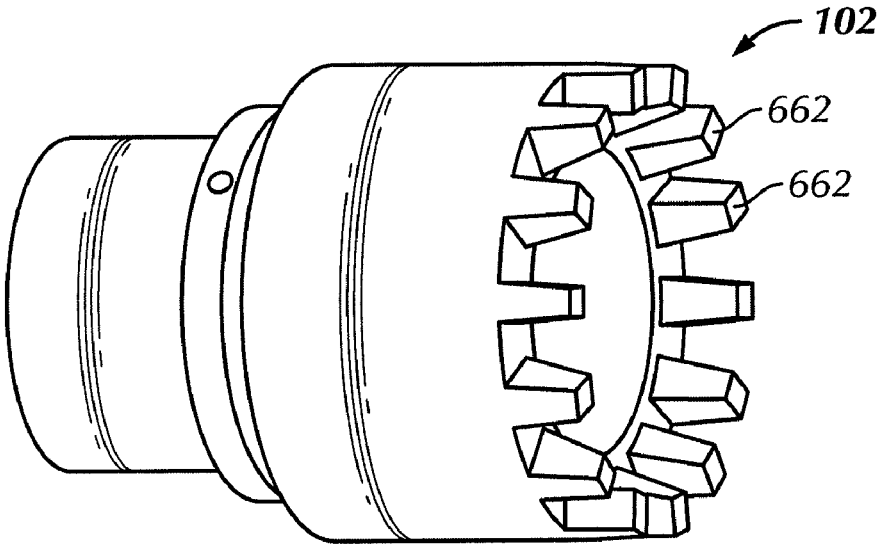
FIG. 9 is a perspective view of an upper gage ring in accordance with embodiments disclosed herein.

Referring now to FIG. 9, the upper gage ring 102 includes a plurality of castellations 662 on a lower end. As discussed above, the plurality of castellations 662 are configured to engage the plurality of castellations 557 of the upper and lower slip assemblies 106, 108, for example, the frangible anchor device 555 (see FIG. 8). The upper gage ring 102 further includes an internal thread (not shown) configured to thread with an external thread of an axial lock ring (125 in FIG. 2B) disposed around the mandrel (101 in FIG. 2).

Referring generally to FIG. 2B, the axial lock ring 125 is a cylindrical component that has an axial cut or slit along its length, an external thread, and an internal thread. As discussed above, the external thread engages the internal thread (not shown) of the upper gage ring 102. The internal thread of the axial lock ring 125 engages an external thread of the mandrel 101. When assembled, the upper gage ring 102 houses the axial lock ring.

Figure 10:
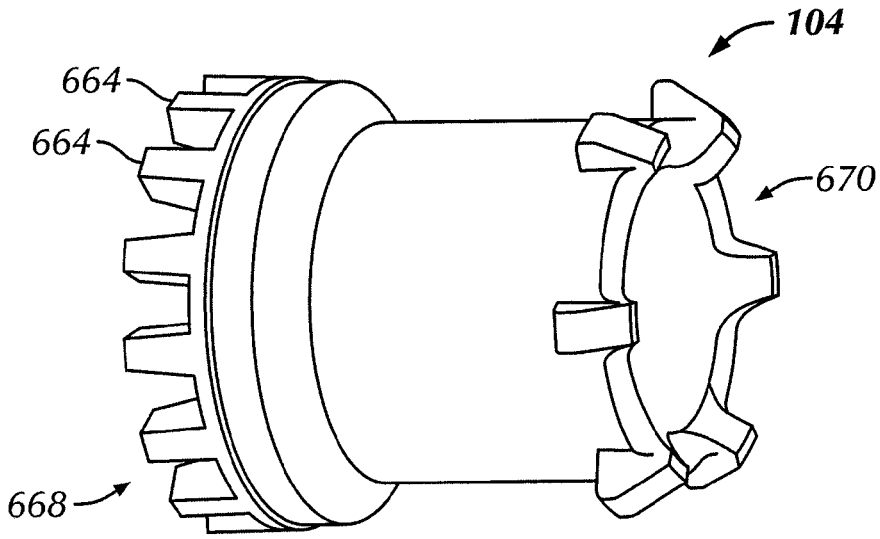
FIG. 10 is a perspective view of a lower gage ring in accordance with embodiments disclosed herein.

Referring now to FIG. 10, the lower gage ring 104 includes a plurality of castellations 664 on an upper end 668. As discussed above, the plurality of castellations 664 are configured to engage the plurality of castellations 557 of the upper and lower slip assemblies 106, 108, for example, frangible anchor device 555 (see FIG. 8). A box thread (not shown) is formed in a lower end 670 of the lower gage ring 104 and configured to engage a pin thread on an upper end of a second mandrel when using multiple plugs. In one embodiment, the box thread may be a taper thread. A box thread (not shown) is also formed in the upper end 668 of the lower gage ring 104 and configured to engage a pin thread on the lower end B of the mandrel 101 (see FIG. 2B). During a drilling/milling process, the lower gage ring 104 will be released and fall down the well, landing on a top of a lower plug. Due to the turning of the bit, the lower gage ring 104 will rotate as it falls and make up or threadedly engage the mandrel of the lower plug.

Referring generally to FIGS. 2-11, after the drillable bridge plug 100 is disposed in the well in its desired location, the bridge plug 100 is activated or set using an adapter kit. The plug 100 may be configured to be set by wireline, coil tubing, or conventional drill string. The adapter kit mechanically pulls on the mandrel 101 while simultaneously pushing on the upper gage ring 102, thereby moving the upper gage ring 102 and the mandrel 101 in opposite directions. The upper gage ring 102 pushes the axial lock ring, the upper slip assembly 106, the upper cone 110, and the element barrier assembly 116 toward an upper end of the sealing element 114, and the mandrel pulls the lower gage ring 104, the lower slip assembly 108, the lower cone 112, the rotational locking key, and the lower element barrier assembly 116 toward a lower end of the sealing element 114. As a result, the push and pull effect of upper gage ring 102 and the mandrel 101 compresses the sealing element 114.

Compression of the sealing element 114 expands the sealing element into contact with the inside wall of the casing, thereby shortening the overall length of the sealing element 114. As the bridge plug components are compressed, and the sealing element 114 expands, the adjacent element barrier assemblies 116 expand into engagement with the casing wall. As the push and pull forces increase, the rate of deformation of the sealing element 114 and the element barrier assemblies 116 decreases. Once the rate of deformation of the sealing element is negligible, the upper and lower cones 110, 112 cease to move towards the sealing element 114. As the activating forces reach a preset value, the castellations 662, 664 of the upper and lower cones 110, 112 engaged with the castellations 557 of the upper and lower slip assemblies 106, 108 breaks the slip assemblies 106, 108 into desired segments and simultaneously guide the segments radially outward until the slips 557 engage the casing wall. After the activating forces reach the preset value, the adapter kit is released from the bridge plug 100, and the plug is set.

Figure 12:
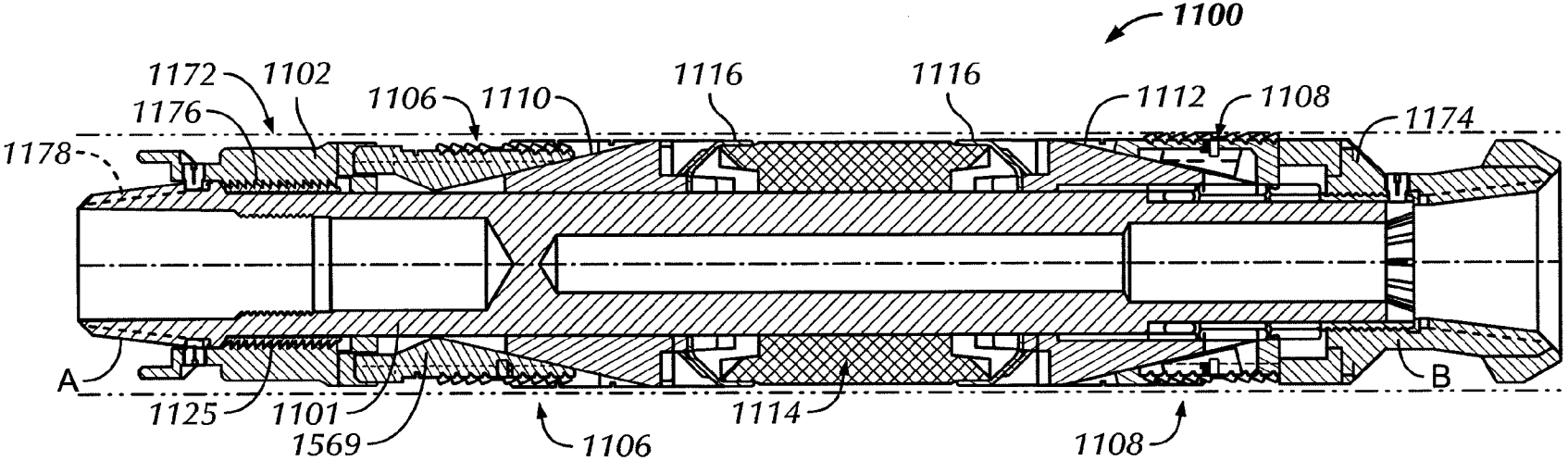
FIG. 12 is a cross-sectional view of a bridge plug in an unexpanded condition in accordance with embodiments disclosed herein.
Figure 13:
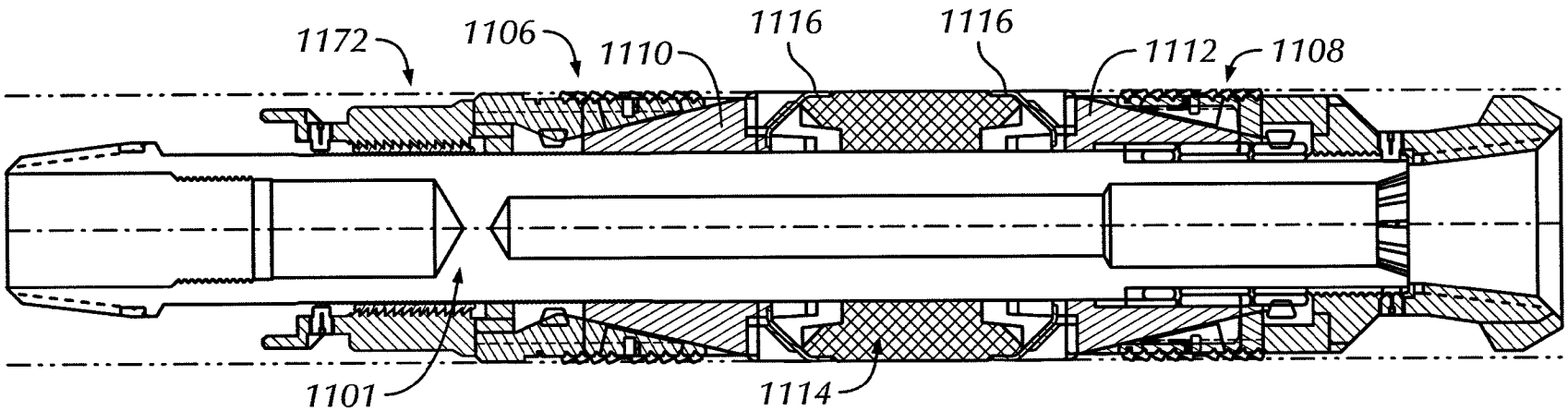
FIG. 13 is a cross-sectional view of the bridge plug of FIG. 12 in an expanded condition in accordance with embodiments disclosed herein.

Referring now to FIG. 12, a bridge plug 1100 in an unexpanded condition is shown in accordance with an embodiment of the present disclosure. FIG. 13 shows the bridge plug 1100 in an expanded condition. Bridge plug 1100 includes a mandrel 1101, a sealing element 1114, element barrier assemblies 1116 disposed adjacent the sealing element 1114, an upper and lower slip assembly 1106, 1108, upper and lower cones 1110, 1112, a locking device 1172, and a bottom sub 1174.

The mandrel 1101 may be formed as discussed above with reference to FIG. 2. For example, mandrel 1101 may include a fixed bridge, as shown in FIG. 2B, or a movable bridge, as shown in FIG. 2C. A ratchet thread 1176 is disposed on an outer surface of an upper end A of mandrel 1101 and configured to engage locking device 1172. Upper end A of mandrel 1101 includes a threaded connection 1178 configured to engage a threaded connection in a lower end of a mandrel when multiple plugs are used. As discussed above, the mandrel 1101 may be formed from any material known in the art, for example an aluminum alloy.

Figure 14B:
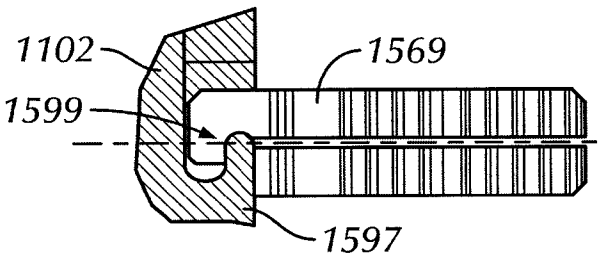
FIG. 14B is a top view of a slip base in accordance with embodiments disclosed herein.
Figure 14A:
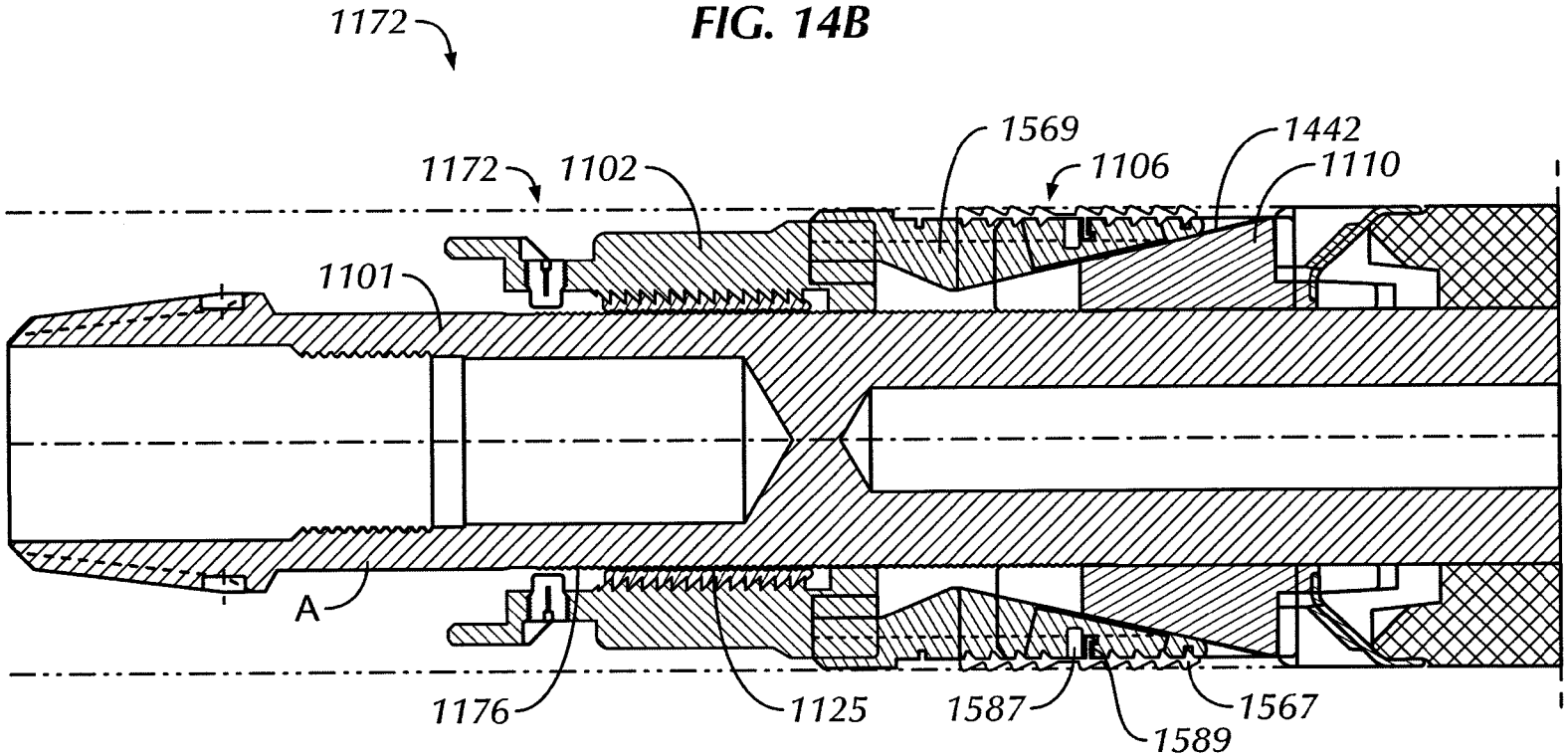
FIG. 14A is a partial cross-section view of a bridge plug in accordance with embodiments disclosed herein.

As shown in greater detail in FIG. 14, the locking device 1172 includes an upper gage ring, or lock ring housing, 1102, and an axial lock ring 1125. When a setting load or force is applied to the bridge plug 1100, the axial lock ring 1125 may move or ratchet over the ratchet thread 1176 disposed on an outer surface of the upper end A of mandrel 1101. Due to the configuration of the mating threads of the axial lock ring 1125 and the ratchet thread 1176, after the load is removed, the axial lock ring 1125 does not move or return upward. Thus, the locking device 1172 traps the energy stored in the sealing element 1114 from the setting load.

Further, when pressure is applied from below the bridge plug 1100, the mandrel 1101 may move slightly upward, thus causing the ratchet thread 1176 to ratchet through the axial lock ring 1125, thereby further pressurizing the sealing element 1114. Movement of the mandrel 1101 does not separate the locking device 1172 from the upper slip assembly 1106 due to an interlocking profile between the locking device 1172 and slip base 1569 (or frangible anchoring device, not independently illustrated) of the upper slip assembly 1106, described in greater detail below.

Figure 15B:
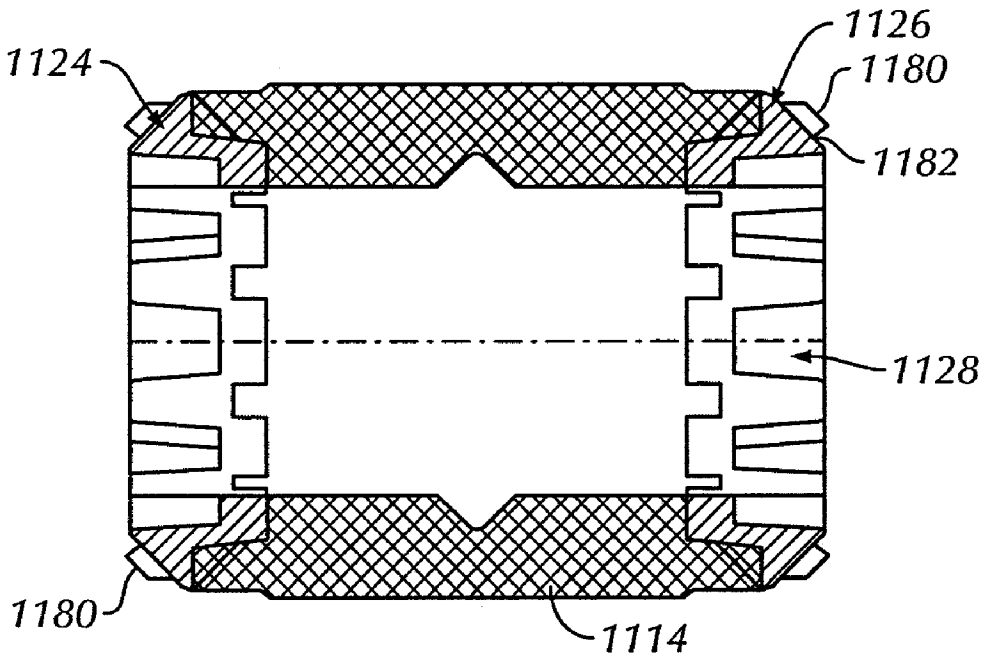
FIGS. 15A and 15B are cross-sectional views of a sealing element in accordance with embodiments disclosed herein.
Figure 15A:
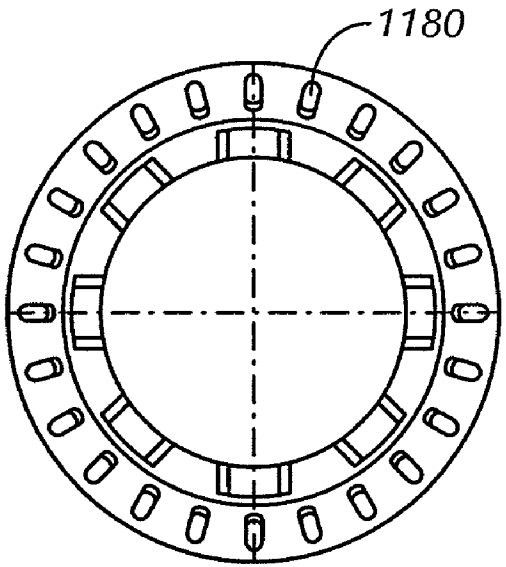
Figures 16A, 16B, 16C:
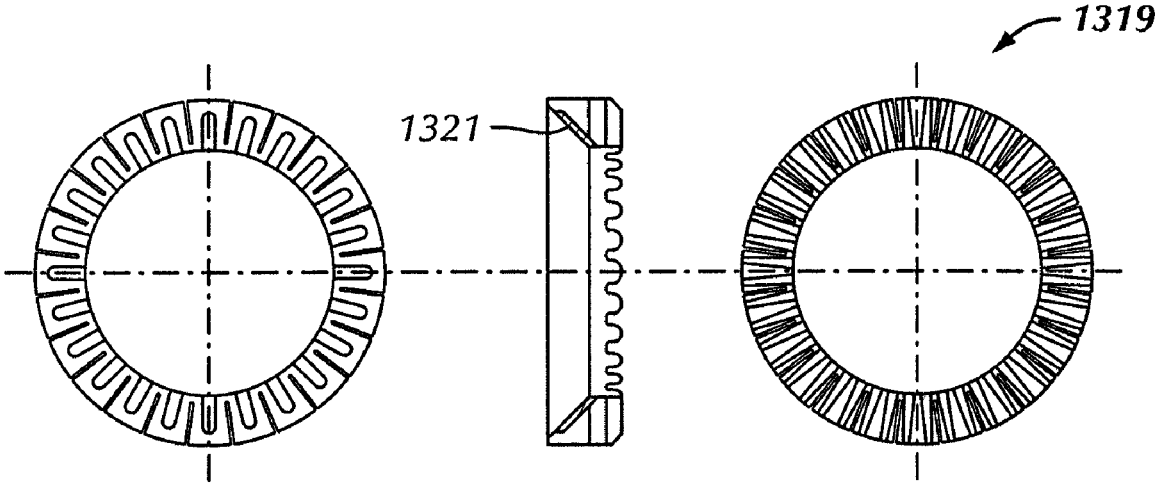
FIGS. 16A, 16B, and 16C are multi-angle views of a frangible backup ring in accordance with embodiments disclosed herein.

Referring now to FIGS. 12 and 15A-B, sealing element 1114 is disposed around mandrel 1101. Two element end rings 1124, 1126 are disposed around the mandrel 1101 and proximate either end of the sealing element 1114, with at least a portion of each of the element end rings 1124, 1126 disposed radially inward of the sealing element 114. In one embodiment, sealing element 1114 is bonded to an outer circumferential area of the element end rings 1124, 1126 by any method know in the art. Alternatively, the sealing element 1114 is molded with the element end rings 1124, 1126. The element end rings 1124, 1126 formed from any material known in the art, for example, plastic, phenolic resin, or composite material.

The element end rings 1124, 1126 have at least one groove or opening 1128 formed on an axial face and configured to receive a tab (not shown) formed on the end of an upper cone 1110 and a lower cone 1112, respectively, as discussed above in reference to FIGS. 2-11. One of ordinary skill in the art will appreciate that the number and location of the grooves 1128 formed in the element end rings 1124, 1126 corresponds to the number and location of the tabs (not shown) formed on the upper and lower cones 1110, 1112.

Figures 17A, 17B:
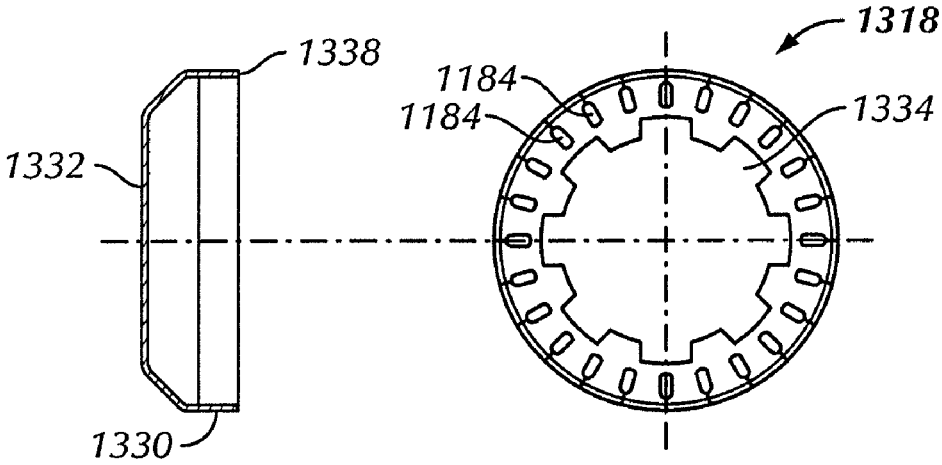
FIGS. 17A and 17B are multi-angle views of a barrier ring in accordance with embodiments disclosed herein.

As shown in FIGS. 15A-B, element end rings 1124, 1126 further include at least one protrusion 1180 disposed on an angled face 1182 proximate the outer circumferential edge of the element end rings 1124, 1126. The protrusions 1180 are configured to be inserted into corresponding openings (1184 in FIGS. 17A-B) in a barrier ring (1318 in FIGS. 17A-B), discussed in greater detail below. In certain embodiment, the protrusions 1180 may be bonded to or molded with the element end rings 1124, 1126.

The element barrier assemblies 1116 are disposed adjacent the element end rings 1124, 1126 and sealing element 1114. Element barrier assembly 1116 includes a frangible backup ring 1319 and a barrier ring 1318, as shown in FIGS. 16A-C and 17A-B, respectively. Frangible ring 1319 may be formed from any material known in the art, for example, plastic, phenolic resin, or composite material. Additionally, frangible ring 1319 may be formed with slits or cuts 1321 at predetermined locations, such that when the frangible ring 1319 breaks during setting of the bridge plug 1100, the frangible ring 1319 segments at predetermined locations, i.e., at the cuts 1321.

The barrier ring 1318 is a cap-like component that has a cylindrical body 1330 with a first face 1332. First face 1332 has a circular opening therein such that the barrier ring 1318 is configured to slide over the mandrel 1101 into a position adjacent the sealing element 1114 and the element end ring 1124, 1126. At least one slot 1334 is formed in the first face 1332 and configured to align with the grooves 1128 formed in the element end rings 1124, 1126 and configured to receive the tabs formed on the upper and lower cones 1110, 1112. One of ordinary skill in the art will appreciate that the number and location of the slots 1334 formed in the first face 1332 of the barrier ring 1318 corresponds to the number and location of grooves 1128 formed in the element end rings 1124, 1126 and the number and location of tabs (not shown) formed on the upper and lower cones 1110, 1112. Further, a plurality of openings 1184 are formed in the first face 1332 of the barrier ring 1318 and configured to receive the protrusions 1180 of the element end ring 1124, 1126. Thus, the protrusions 1180 rotationally lock the element barrier assembly 1116 with the sealing element 1114. One of ordinary skill in the art will appreciate that the number and location of the openings 1184 formed in the first face 1332 of the barrier ring 1318 corresponds to the number and location of protrusions formed in the element end rings 1124, 1126.

A plurality of slits (not shown) are disposed on the cylindrical body 1330 of the barrier ring 1318, each slit extending from a second end 1338 of the barrier ring 1318 to a location behind the front face 1332, thereby forming a plurality of flanges (not shown). When the setting load is applied to the bridge plug 1100, the frangible backup rings 1319 break into segments. The segments expand and contact the casing. The space between the segments in contact with the casing is substantially even, because the protrusions 1180 of the element end rings 1124, 1136 guide the segmented frangible backup rings 1319 into position. When the setting load is applied to the bridge plug 1100, the barrier rings 1318 expand and the flanges of the barrier rings 318 disposed on each end of the sealing element 1114 radially expand against the inner wall of the casing. The expanded flanges cover any space between the segments of the frangible backup rings 319, thereby creating a circumferential barrier that prevents the sealing element 1114 from extruding.

Referring back to FIGS. 12 and 14, upper and lower slip assemblies 1106, 1108 are configured to anchor the bridge plug 1100 to the casing and withstand substantially high loads as pressure is applied to the bridge plug 1100. Upper and lower slip assemblies 1106, 1108 include slip bases 1569, slips 1567, and slip retaining rings 1587. Upper and lower slip assemblies 1106, 1108 are disposed adjacent upper and lower cones 1110, 1112, respectively, such that conical inner surfaces of the slip base 1569 are configured to engage a sloped surface 1442 of the cones 1110, 1112.

Slip base 1569 of upper slip assembly 1106 includes a locking profile 1599 on an upper face of the slip base 1569. Locking profile 1599 is configured to engage the upper slip base 1569 with the upper gage ring 1102. Thus, upper gage ring 1102 includes a corresponding locking profile 1597 on a lower face. For example locking profiles 1599, 1597 may be interlocking L-shaped protrusions, as shown in FIG. 14B. As discussed above, these locking profiles 1597, 1599 secure the slip base 1569 to the upper gage ring 1102 during pressure differentials across the bridge plug 1100, thereby maintaining energization of the sealing element 1114. Further, L-shaped protrusions are less likely to break off than typical T-shaped connections and more likely to be efficiently drilled up during a drilling/milling process.

Slips 1567 may be configured as teeth, sharp threads, or any other device know to one of ordinary skill in the art for gripping or biting into a casing wall. In one embodiment, slips 1567 may include a locking profile that allows assembly of the slips 1567 to the slip base 1569 without additional fasteners or adhesives. The locking profile includes a protrusion portion 1589 disposed on an inner diameter of the slip 1567 and configured to be inserted into the slip base 1569, thereby securing the slip 1567 to the slip base 1569. Protrusion portion 1589 may be, for example, a hook shaped or L-shaped protrusion, to provide a secure attachment of the slip 1567 to the slip base 1569. One of ordinary skill in the art will appreciate that protrusions with different shapes and/or profiles may be used without departing from the scope of embodiments disclosed herein.

Slip base 1569 may be formed from a readily drillable material, while slips 1567 are formed from a harder material. For example, in one embodiment, the slip base 1569 is formed from a low yield cast aluminum and the slips 1567 are formed from cast iron. Alternatively, slip base 1569 may be formed from 6061-T6 aluminum alloy while slips 1567 are formed from induction heat treated ductile iron. One of ordinary skill in the art will appreciate that other materials may be used and that in certain embodiments the slip base and the slips may be formed from the same material without departing from the scope of embodiments disclosed herein.

Slip retaining rings 1587 are disposed around the slip base 1569 to secure the slip base 1569 to the bridge plug 1100 prior to setting. The slip retaining rings 1587 typically shear at approximately 16,000-18,000 lbs, thereby activating the slip assemblies 1106, 1108. After activation, the slip assemblies 1106, 1108 radially expand into contact with the casing wall. Once the slips 1567 contact the casing wall, a portion of the load applied to the sealing element 1114 is used to overcome the drag between the teeth of the slips 1567 and the casing wall.

While select embodiments of the present disclosure describe certain features of a bridge plug, one of ordinary skill in the art will appreciate that features discussed with respect to one embodiment may be used on alternative embodiments discussed herein. Further, one of ordinary skill in the art will appreciate that certain features described in the present disclosure may be applicable to both bridge plugs and frac plugs, and that use of the term bridge plug herein is not intended to limit the scope of embodiments to solely bridge plugs.

Advantageously, embodiments disclosed herein provide one or more barrier rings that creates a circumferential barrier ring with a bridge plug is set to prevent or reduce the amount of extrusion of the sealing element of a bridge plug. Further, anchoring devices in accordance with embodiments of the present disclosure provide a more even stress distribution on a cone and/or the casing wall.

Advantageously, a bridge plug in accordance with embodiments of the present disclosure includes a segmented anchoring device such that the circumferential length of the segments is shorter as compared to conventional anchoring devices. As such, when actuated, the entire circumferential length of these anchoring segments may penetrate the casing wall, resulting in maximum contact surface between the anchoring segments and the casing wall, i.e. minimum uniform stress distribution between the anchoring device and the adjacent cone. Therefore, damage to the anchoring device and the cone may be prevented or reduced.

Further, embodiments disclosed herein advantageously provide a bridge plug that provides more efficient and quicker drilling/milling processes. Because components of the a bridge plug in accordance with the present disclosure are rotationally locked with one another, spinning of the components during drilling/milling processes is eliminated, thereby resulting in faster drilling/milling times.

Still further, a bearing shoulder provided in a lower cone of a bridge plug in accordance with the present disclosure allows a mandrel to stay engaged for a longer amount of time during a drilling/milling process than a conventional bridge plug. The bearing shoulder may allow for retention of the mandrel until the bearing shoulder is drilled up. Thus, the portion of the plug that remains in the well after the drilling/milling process is reduced.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole tool for isolating zones in a well, the tool comprising:

a mandrel;

a sealing element disposed around the mandrel;

an upper cone disposed around the mandrel proximate an upper end of the sealing element;

an upper slip assembly disposed around the mandrel adjacent a sloped surface of the upper cone;

a lower cone disposed around the mandrel proximate a lower end of the sealing element;

a lower slip assembly disposed around the mandrel adjacent a sloped surface of the lower cone;

two element end rings, a first element end ring disposed adjacent the upper end of the sealing element and a second element end ring disposed adjacent the lower end of the sealing element; and two element barrier assemblies, each assembly disposed adjacent one of the two element end rings, wherein at least a portion of the element end rings is disposed radially inward of the sealing element.

2. The downhole tool of claim 1, wherein in the sealing element is bonded to the two element end rings.

3. The downhole tool of claim 1, wherein each of the two element barrier assemblies further comprises two barrier rings.

4. The downhole tool of claim 3, wherein each of the two barrier rings has a cylindrical portion, a first face, and a second end wherein the cylindrical portion is formed with a plurality of slits extending from the second end to a location behind the first face.

5. The downhole tool of claim 4, wherein the slits formed on the first barrier ring are rotationally offset from the slits formed on the second barrier ring.

6. The downhole tool of claim 3, wherein each of the two barrier rings further comprises at least one groove formed in the front face and configured to receive a tab formed on the upper or lower cone.

7. The downhole tool of claim 1, wherein at least one of the upper cone and lower cone are copper plated.

8. The downhole tool of claim 1, wherein each of the two element barrier assemblies comprises a barrier ring and a frangible backup ring.

9. The downhole tool of claim 8, wherein the two element end rings comprise at least one protrusion extending axially away from the sealing element.

10. The downhole tool of claim 9, wherein the barrier ring further comprises a plurality of openings configured to receive the protrusions.

11. The downhole tool of claim 1, further comprising a locking device disposed proximate an upper end of the mandrel, wherein the locking device comprises an upper gage ring and an axial lock ring.

12. The downhole tool of claim 1, further comprising a lower gage ring disposed proximate a lower end of the mandrel, wherein the lower gage ring comprises an internal thread on a lower end of the gage ring.

13. The downhole tool of claim 1, wherein the upper and lower cones further comprise at least one tab disposed on a surface facing the sealing element, and wherein the at least one tab is configured to rotationally lock the upper and lower cones with the element barrier assemblies and the sealing element.

14. The downhole tool of claim 13, wherein the two element end rings comprise at least one groove formed in a face of the element end rings configured to receive the at least one tab.

15. The downhole tool of claim 1, wherein the upper and lower slip assemblies comprise an anchoring device.

16. The downhole tool of claim 15, wherein the anchoring device comprises a conical inner surface configured to engage the sloped surfaces of the upper cone and the lower cones.

17. The downhole tool of claim 15, wherein the anchoring device is a frangible ring having at least two axial slots extending from a second end of the anchoring device.

18. The downhole tool of claim 15, wherein the slip assembly further comprises a slip base and a slip, wherein the slip is disposed on an outer circumference of the slip base.

19. The downhole tool of claim 18, wherein the slip comprises a locking profile configured to engage the slip base.

20. The downhole tool of claim 1, wherein the lower cone comprises a bearing shoulder configured to engage the mandrel.

21. The downhole tool of claim 1, wherein the upper slip assembly comprises an upper end having a plurality of castellations configured to engage a plurality of castellations formed on a lower end of an upper gage ring, and wherein the lower slip assembly comprises a lower end having a plurality of castellations configured to engage a plurality of castellations formed on an upper end of a lower gage ring.

22. A downhole tool for isolating zones in a well, the tool comprising:

a mandrel;

a sealing element disposed around the mandrel;

two slip assemblies disposed around the mandrel, wherein an upper slip assembly is disposed proximate an upper end of the sealing element and a lower slip assembly is disposed proximate a lower end of the sealing element;

an upper cone disposed around the mandrel between the first slip assembly and the upper end of the sealing element; and a lower cone disposed around the mandrel between the first slip assembly and the lower end of the sealing element, wherein the mandrel comprises a central bore and wherein a sealed movable bridge is disposed between two stops in the central bore and configured to move upwardly and downwardly in response to a pressure differential.

23. The downhole tool of claim 22, wherein at least one of the stops comprises a stop block disposed in the central bore.

24. The downhole tool of claim 22, wherein at least one of the stops comprises a reduction in the diameter of the central bore.

* * * * *